United States Patent [19]

DePetris

[11] 3,972,311

[45] Aug. 3, 1976

[54] ELECTRONIC CHOKE CONTROL

[76] Inventor: Peter S. DePetris, 2004 LaSalle Ave., Niagara Falls, N.Y. 14301

[22] Filed: Nov. 20, 1974

[21] Appl. No.: 525,670

[52] U.S. Cl. ..... 123/119 F; 261/39 E

[51] Int. Cl.[2] ..... F02D 11/08; F02M 1/10; F02M 23/04

[58] Field of Search ..... 123/119 F; 261/39 E

[56] References Cited

UNITED STATES PATENTS

| | | | |
|---|---|---|---|
| 3,534,720 | 10/1970 | Du Bois | 123/119 F |
| 3,699,937 | 10/1972 | De Petris | 123/119 F |
| 3,752,133 | 8/1973 | Irish et al. | 123/119 F |
| 3,763,837 | 10/1973 | Orlando | 123/119 F |
| 3,768,453 | 10/1973 | Hurst | 123/119 F |
| 3,800,767 | 4/1974 | Winkley | 123/119 F |
| 3,806,854 | 4/1974 | Armstrong | 123/119 F |
| 3,818,881 | 6/1974 | Hosho et al. | 123/119 F |

*Primary Examiner*—Wendell E. Burns
*Attorney, Agent, or Firm*—Harness, Dickey & Pierce

[57] ABSTRACT

An electrical heating means for the bimetallic thermostatic spring controlling a carburetor automatic choke valve is in series with a negative temperature coefficient thermistor which senses engine temperature to open the choke valve in a more efficient manner and improve engine performance during warm-up. A temperature responsive switch is in series with the heater, negative temperature coefficient thermistor and a battery and senses engine block temperature to maintain current flowing in the heater after the engine is shut off and until the entire engine cools down, to provide better warm-engine restarts and reduce pollution.

10 Claims, 2 Drawing Figures

6
12
8
10
22
16
30
34
20
32
42
4
67
28
18
36
26
41
14
44
24
39
22
66
67
54
57
56
46
2
50
48

30
32
28
36
P
T
C
26
39
48
66
60
58
50
N
T
C
67
44
62
52
69
53
46
64
38
40
56
2

ELECTRONIC CHOKE CONTROL

BACKGROUND OF THE INVENTION

This invention is in the field of automatic choke valves for internal combustion engines and particularly to electrically controlled chokes.

It is conventional in internal combustion engines to provide a carburetor having a choke valve therein controlled by a thermostatic spring whereby the choke valve is held closed when the engine is cold. As the engine warms up, heat is directed to the thermostatic spring causing the same to expand and to open the choke valve until, at normal operating temperatures, the choke valve is substantially fully open. Many ambient conditions affect the operation of such metallic springs and they do not normally open the choke valve at a sufficiently high rate to hold emissions and air pollution to a minimum during engine starts and warm-up. Furthermore, after shutting an engine off, the thermostatic spring is normally subject to ambient air temperatures and normally close the choke valve before the engine block is sufficiently cool. Thus, when such a warm engine is restarted, the choke valve is often closed and this results in excessive fuel being fed to the carburetor with the attendant difficulty in starting, excessive emission of polluting materials and often causes "flooding" of the carburetor.

Previous attempts have been made to overcome the above-mentioned difficulties, such as by directing warm air or warm engine coolant to the vicinity of the thermostatic spring to thus hold the choke valve open for a longer period of time after engine shut-off. However, such prior devices were capable of holding the choke valve open for only a relatively few minutes after engine shut-off, particularly at fairly low surrounding air temperatures. They were not capable of holding the choke valve open long enough to facilitate easy warm-engine start-ups after the elapse of a few minutes.

SUMMARY OF THE INVENTION

It is a principal object of the present invention to provide means for holding a choke valve open, by electrical means, after engine shut-off until the engine block temperature has been lowered sufficiently to require closed-choke starting conditions.

The invention contemplates means for directing battery current through a resistance heater adjacent the thermostatic spring and an engine block temperature-sensing device to terminate operation of the heater only when engine block temperature has reached a predetermined low value.

DESCRIPTION OF A PREFERRED EMBODIMENT

Figure 1:
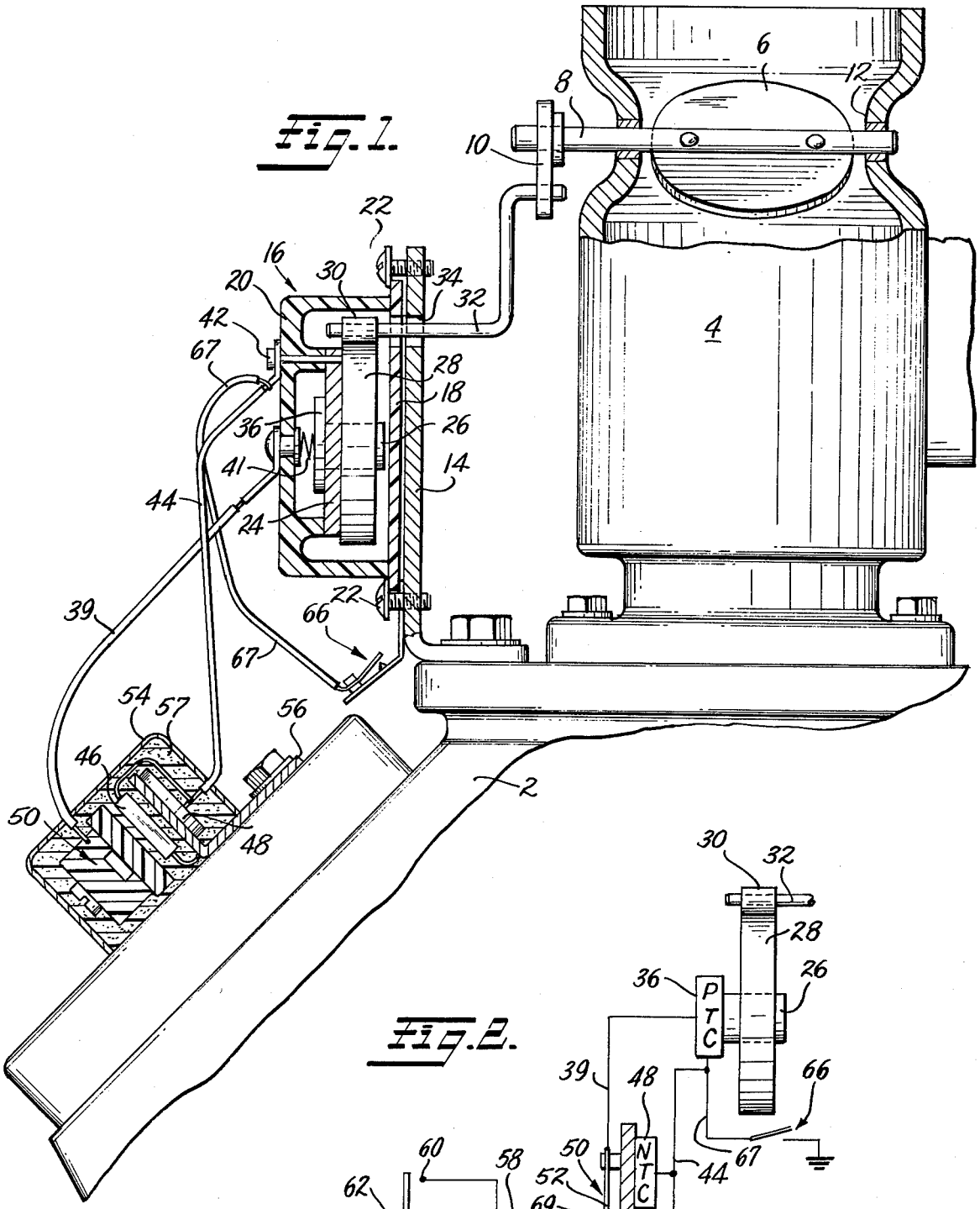
FIG. 1 is a somewhat schematic view, partly in section, of one embodiment of the present invention applied to an internal combustion engine.

In FIG. 1, numeral 2 designates an internal combustion engine block having a carburetor, schematically designated at 4, thereon for feeding an air-fuel mixture to the cylinders of the engine, all as is conventional. The carburetor includes a choke valve 6 mounted on a rotatable shaft 8 having a crank arm 10 thereon. Thus, by rotating the shaft 8, the choke valve 6 may be moved between a position where it is open and offers little resistance to air flow therethrough. A bracket 14 is mounted on the engine block and carries thereon a housing 16 having a base portion 18 and a cover portion 20, preferably of insulating material. Screws 22 hold the housing 16 to the bracket 14 in a manner permitting rotary adjustment of the housing about a horizontal generally central axis thereof, permitting adjustment thereof in a known and conventional manner. Fixedly mounted within the cover 20 is a heat conductive plate 24, preferably of copper, to constitute a "heat-sink" and to which a stub shaft 26 is secured. A spiral bimetallic spring 28 is arranged with its inner end fixed to the stub shaft 26 and its outer end is provided with a loop 30 having an electrically insulating bushing (not identified) therein and in which an arm 32 is fixedly mounted. The arm 32 extends loosely through an arcuate slot 34 in the support bracket 14 and plate 18 and is configured to engage an opening in crank arm 10. The spiral spring 28 may be considered to be the conventional thermostatic spring employed with automatic chokes heretofore and it will be apparent that heating of the spring causes it to expand in a manner to rotate the shaft 8 to open the choke valve described. Obviously, cooling of the spring 28 will result in closing the choke valve.

Numeral 36 designates an electric heating device mounted on the copper plate 24 in heat conductive relation thereto. Thus, when current flows through the heating device 36, the plate 24 and spring 28 are heated by conduction to move the choke valve to open position. The conductor 38 is elctrically connected to normally open (at low temperatures) contacts 52-53 (shown closed in FIG. 2) of thermal switch 50. Conductor 39 from switch 50 connects to spring contactor 41 and the heater 36. The other side of the heater is connected to the plate 24, which in turn is electrically connected to terminal 42 and to a conductor 44.

While any conventional resistance heater may be employed as the heater 36, it is preferred that it be a positive temperature coefficient resistor (PTC). The conductor 44 connects heater 36 in series with a negative temperature coefficient resistor (NTC) 48, which may be shunted by resistor 46 or a thermistor.

Figure 2:
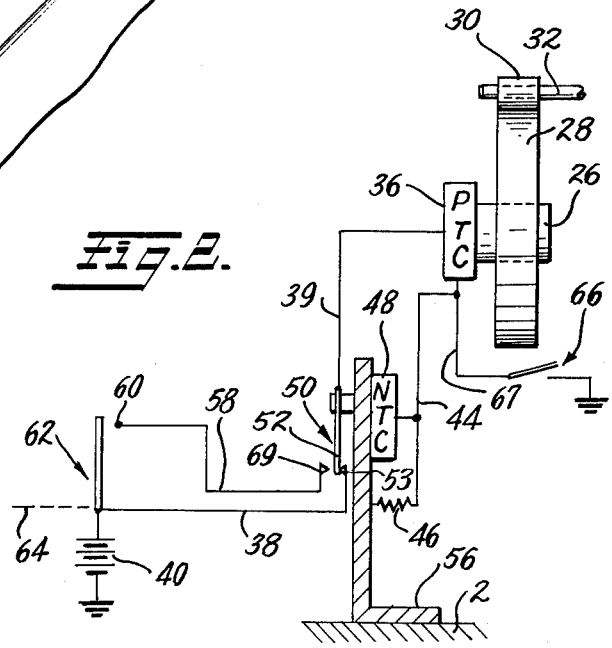
FIG. 2 is a schematic circuit diagram of one arrangement of electrical circuit that may be employed with the device shown in FIG. 1.

The thermo switch 50 may be any suitable type of switching device responsive to temperature to close a circuit through contacts 52 and 53 when it is warm and to open the circuit when it is below a predetermined temperature. As shown in FIG. 2, the thermo switch 50 is represented by a bimetallic snap switch contact device 52, although it is to be understood that other thermally responsive switching devices could be employed, such as, for example, temperature responsive transistor devices or other solid state switching means. As shown in FIG. 1, the NTC 48 and thermo switch 50 are housed in a housing 54 and are supported by a heat conductive bracket 56, preferably of copper, in intimate heat conductive contact with a portion of the engine block 2 or other part of the engine which holds heat. Preferably, the NTC 48, resistor 46 and thermo switch 50 are "potted" within the housing 54 by suitable potting material 57 and are thus essentially the same as that of the engine.

As suggested in FIG. 2, a second thermo switch 66, closed when heated, could have one of its terminals connected to plate 24 by conductor 67, and the other switch terminal grounded. This switch bypasses the N.T.C. 48 controller to open the choke at an accelerated rate if the switch 50 has opened but the ambient temperature is still above approximately 80°F. The thermoswitch 66 is mounted to be exposed to ambient air temperature. FIG. 2 also shows an electrical conductor 58 connected to one contact 69 of the thermo switch and to a terminal 60 of a switch 62. Broken line 64 designates a mechanical or other connection to the conventional ignition switch of an internal combustion engine such that the switch 62 is open when the engine ignition is "off" and is closed when the engine ignition switch is closed and the engine is presumably running.

Assume that the engine is cold, stopped, and that the choke valve 6 is in its closed position, the thermo switch 50 being cold and open from conductor 39 but closed to conductor 58. The above are the conditions existing at the time of a cold engine start. When the engine is started, the switch 62 is closed and it will be seen that a circuit is completed from battery 40, through PTC 36, and both resistor 46 and NTC 48 to ground. Thus, current flows through the heater 36 and NTC 48. This current flow energizes heater 36 to heat the spiral spring 28 faster than it would normally be heated by heat from the engine and thus the choke valve is opened more rapidly with more efficient operation of the engine and a minimum discharge of pollutants. As the temperature of heater 36 increases, its resistance increases, and as the engine temperature increases, the NTC also becomes warmer and its resistance thus decreases to ensure maintenance of the choke 6 in an open condition. The above operation during a cold start is fully described in applicant's prior U.S. Pat. No. 3,699,837 and reference is made thereto.

Now assume that the engine has been stopped by opening the conventional ignition switch. As previously described, opening of the ignition switch and stopping of the engine results in opening switch 62, to the condition shown in FIG. 2. However, since the engine block 2 is warm at this time, thermo switch 50 remains closed at contact 53 to conductor 38 and thus maintains a series electrical circuit through the battery, thermo switch 50, heater 36, NTC 48 and current continues to flow from the battery through the heater 36, maintaining the heater in a warm condition and maintaining the choke valve open even though the engine has stopped running. Since the thermo switch 50 and the NTC 48 are maintained, at substantially engine temperature, the thermo switch 50 will remain closed to conductor 38 and the resistance of 48 increases, as the engine cools, until the engine block reaches a predetermined low temperature. Preferably, the thermo switch 50 is set to open from contact 53 at a temperature of approximately 120°F, at which time the engine may be considered to be in condition for a cold start. However, it takes some time for the thermostatic spring 28 to cool sufficiently to close the choke valve 6 and it has been found that time interval is sufficient for the engine to further cool to "cold" condition.

Thus, applicant has provided an arrangement wherein battery current is employed to hold a choke valve open until an idle engine has cooled sufficiently to necessitate a closed-choke start.

While a limited specific embodiment of the invention has been shown and described herein, the same is merely illustrative of the principles involved and other embodiments may be devised, within the scope of the appended claims.

I claim:

1. In an engine having a carburetor choke valve, temperature responsive thermostat means for holding said choke valve closed at low temperatures and for opening said choke valve at higher temperatures, and a source of electric power, the improvement comprising:

electrical heating means in heat conductive relation to said thermostat means for heating the same; and temperature responsive switching means in series with said source and said electrical heating means, said switching means being mounted in heat conductive relation to a portion of said engine and arranged to be conductive when said portion is above a predetermined temperature and to be non-conductive when said portion cools to a value below said predetermined temperature whereby to maintain current flow from said source through said heating means as long as said portion is above said temperature, irrespective of operation of said engine.

2. The improvement defined in claim 1 including a negative temperature coefficient thermistor in series with said heating means and said source and being in heat conductive relation to a portion of said engine.

3. The improvement defined in claim 1 wherein said electrical heating means is a positive temperature coefficient thermistor.

4. The improvement defined in claim 1 wherein said switching means comprises a temperature responsive switch having relatively movable contacts.

5. The improvement defined in claim 2 including a further temperature responsive switch, closed at elevated temperatures, connected to said electrical heating means to maintain a circuit therethrough in parallel with said negative temperature coefficient thermistor.

6. In a choke system for an internal combustion engine having a carburetor choke valve, temperature responsive means for moving said choke valve between a closed position and an opened position, a source of electrical power, electrical heating means in heat conducting relation to said temperature responsive means for heating said temperature responsive means, the improvement comprising first circuit means including, an ignition switch for providing current from said source to said electrical heating means, said ignition switch being operative to open said first circuit means for interrupting the current flow to said electrical heating means when said ignition switch is open, and second circuit means for providing current from said source to said electrical heating means independently of said ignition switch, said second circuit means including a temperature responsive element in heat conductive relation to a portion of the engine and adapted to be conductive when that portion of the engine is above a predetermined temperature and to be non-conductive when that portion of the engine is below the predetermined temperature to maintain current flow from said source through said electrical heating means irrespective of the condition of said ignition switch.

7. A choke system as set forth in claim 6 wherein the first circuit means further includes a negative temperature coefficient thermistor in series with said electrical heating means for controlling the amount of current flowing through said electrical heating means in response to temperature when said ignition switch is closed.

8. A choke system as set forth in claim 6 wherein the electrical heating means is a positive temperature coefficient thermistor.

9. A choke system as set forth in claim 8 wherein the first circuit means further includes a negative temperature coefficient thermistor in series with said electrical heating means for controlling the amount of current flowing through said electrical heating means in response to temperature when said ignition switch is closed.

10. A choke system as set forth in claim 7 further including a temperature responsive switch in parallel circuit with the negative temperature coefficient thermistor and said electrical heating means for shunting said negative temperature coefficient thermistor, said temperature responsive switch being adapted to close at a temperature above a predetermined value for maintaining the current flow through said electrical heating means regardless of the condition of said negative temperature coefficient thermistor.

* * * * *